United States Patent [19]

van den Einden et al.

[11] 3,991,338

[45] Nov. 9, 1976

[54] CONVERGENCE UNIT HAVING THREE IDENTICAL V-SHAPE BENT PLATES FOR SHIELDING POLE SHOES

[75] Inventors: Henricus Franciscus Petrus van den Einden; Antonius Wilhelmus Franciscus van der Heijden, both of Eindhoven, Netherlands

[73] Assignee: U.S. Philips Corporation, New York, N.Y.

[22] Filed: Feb. 5, 1975

[21] Appl. No.: 547,105

[30] Foreign Application Priority Data

Feb. 26, 1974 Netherlands ..... 7402578

[52] U.S. Cl. ..... 313/417

[51] Int. Cl.[2] ..... H01J 29/51; H01J 29/82

[58] Field of Search ..... 313/412, 413, 414, 409, 313/417

[56] References Cited

UNITED STATES PATENTS

| | | | |
|---|---|---|---|
| 3,215,880 | 11/1965 | Krackhardt | 313/451 |
| 3,689,791 | 9/1972 | McQueen et al. | 313/412 |
| 3,710,164 | 1/1973 | Rimmler | 313/412 |
| 3,725,712 | 4/1973 | Sawagata | 313/412 |

*Primary Examiner*—Robert Segal

*Attorney, Agent, or Firm*—Frank R. Trifari; George B. Berka

[57] ABSTRACT

A color cathode-ray tube wherein a convergence unit comprises a symmetric shielding assembly in the form of three identical V-shaped bent plates, secured to each other by only three welds.

3 Claims, 5 Drawing Figures

Figure 1:
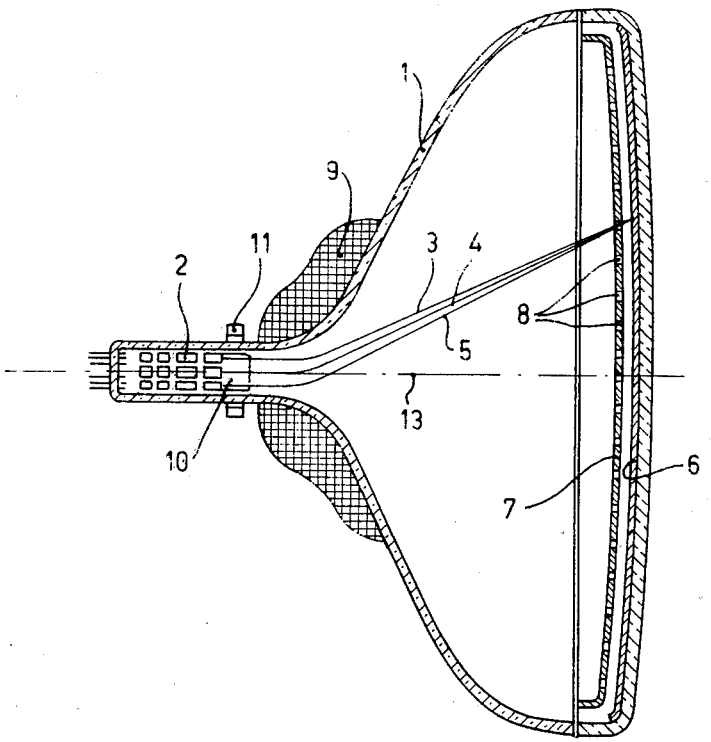

CONVERGENCE UNIT HAVING THREE IDENTICAL V-SHAPE BENT PLATES FOR SHIELDING POLE SHOES

The invention relates to a cathode-ray tube for displaying coloured pictures and comprising in an evacuated envelope means to generate three electron beams, a display screen comprising a large number of regions luminescing in three different colours, a colour selection electrode having a large number of apertures and means to converge the electron beams on the display screen, which electron beams are each associated with luminescent regions of one colour by means of the colour selection electrode, which convergence means comprise a cylindrical sleeve to which three pairs of ferromagnetic pole shoes extending radially inwardly are secured and in which means are present to shield the magnetic fields from the said pole shoes which consists of three V-shaped bent plates the tops of which join each other along the axis of the said cylindrical sleeve and of which the first and second ends extend from said axis towards the wall of the said cylindrical sleeve in such manner that the space in said cylindrical sleeve is divided into three compartments in which the said pairs of pole shoes are present.

Such a cathode-ray tube is described in the U.S. Pat. No. 3,689,791. In such a cathode-ray tube, three electron beams are generated which are converged on the display screen by means of three pairs of ferromagnetic pole shoes. This is carried out by means of the field between the pole shoes of each pair, which field is generated by means of an external convergence unit which is present outside the said envelope and cooperates with the pole shoes. The magnetic field in each of the pole shoes can deflect the relevant beam radially in such manner that the beams intersect each other substantially in a point at the area of the display screen.

The convergence unit in the cathode-ray tube consists of a cylindrical sleeve of non-magnetic material which has an apertured bottom. The top side of the cylindrical sleeve is open. The said pole shoes extend radially inwardly in said cylindrical sleeve. The cylindrical sleeve furthermore comprises means of a ferromagnetic material to shield the magnetic fields between the said pole shoes which generally consist of three V-shaped bent plates the tops of which join each other along the axis of the cylindrical sleeve and the ends extend in such manner towards the wall that the space in the cylindrical sleeve is divided into three identical compartments in which the said pole shoes are present.

Lugs of the ends of said V-shaped bent plates project through apertures in the cylindrical sleeve and are then welded. Hence six welds are necessary for said three plates.

The said United States Patent Specification describes a construction which reduces said number of welds from six to three, but said construction has the drawback that the systems of means to screen the magnetic fields is not symmetrical and is manufactured from two different parts.

It is the object of the invention to provide a construction which does not consist of different parts and which is symmetrical while the number of welds is restricted to three.

According to the invention, a cathode-ray tube of the type mentioned in the first paragraph is characterized in that the said V-shaped bent plates have at their first end a lug which projects through an aperture in the cylindrical sleeve and, after bending, is welded to the outer wall thereof, and have at their second end (a) means for fixing relative to the first end of the adjoining V-shaped plate in the radial and axial directions of the cylindrical sleeve, (b) a short projection which extends in an aperture in the cylindrical sleeve for fixation in a tangential direction and is not welded.

The fixation means mentioned sub (a) may consist of a projecting part at one of the said ends (for example a bulge, a lug) and a recess in the engaging end (for example a hole or slot).

Figure 2:
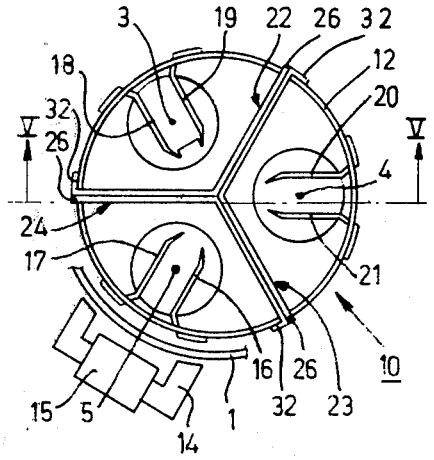
Figure 3:
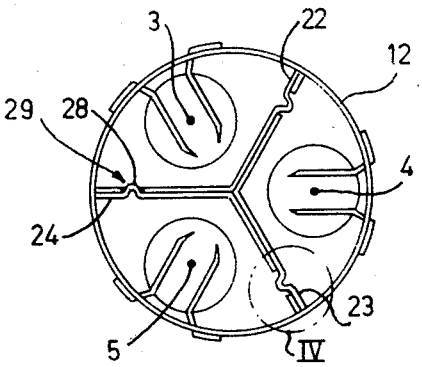
Figure 4:
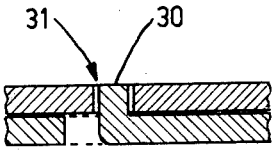
Figure 5:
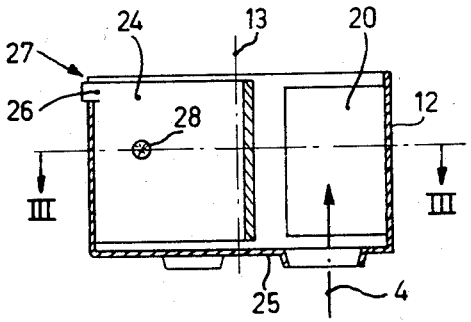

It is an advantage in the manufacture that three identical V-shaped bent plates can be manufactured. Another advantage is the smaller number of welds with a smaller risk of the occurrence of welding sputters which cause separate parts in the tube, which may result in short-circuit in the means to generate electron beams. The invention will be described in greater details with reference to the accompanying drawing, of which:

FIG. 1 shows a cathode-ray tube for displaying coloured pictures according to the invention, FIG. 2 is an elevation of the internal convergence unit of the tube, FIG. 3 is a sectional view according to a plane at right angles to the cylinder axis and taken on the line III—III of FIG. 5, FIG. 4 is a sectional view analogous to FIG. 3 of another embodiment, FIG. 5 is a sectional view taken on the line V—V of FIG. 2.

The cathode-ray tube for displaying coloured pictures shown in FIG. 1 is of the shadow mask type and comprises an evacuated glass envelope 1, a set of electron guns 2 in triangular arrangement to generate three electron beams 3, 4 and 5, a display screen 6 comprises a large number of regions luminescing in red, green and blue, respectively, a colour selection electrode 7 comprising a large number of apertures 8, and a set of deflection coils 9 for scanning the display screen 6 with the electron beams 3, 4 and 5. The electron beams 3, 4 and 5 are converged on the display screen 6 by means of an internal convergence unit 10 and an external convergence unit 11. The internal convergence unit 10 comprises a cylindrical sleeve 12 which is coaxial with the axis 13 of the cathode-ray tube.

FIG. 2 is an elevation of the internal convergence unit 10 viewed from the side of the shadow mask 7. The co-operation of the internal convergence unit 10 with the external convergence unit 11 is shown diagrammatically with an external magnetic circuit 14 having a coil 15. A current through coil 15 causes a magnetic field between the pole shoes 16 and 17 which causes a radial displacement of the electron beam 5. In a similar manner the electron beam 3 is influenced by the field between the pole shoes 18 and 19 and the electron beam 4 by the field between the pole shoes 20 and 21. In this manner the electron beams 3, 4, and 5 can be converged in one point on the display screen 6. The pairs of pole shoes are shielded relative to each other by ferromagnetic V-shaped bent plates 22, 23 and 24. It is obvious that V-shaped bent plates the top of which is more or less circular may also be used. The cylindrical sleeve 12 has a bottom plate 25 which has three apertures for passing the electron beams 3, 4 and 5. The ferromagnetic V-shaped bent plates are fixed in a tangential direction by a short projection 26 which passes through the hole 27 and bent lug 32 which also passes through hole 27 and is moreover welded.

FIG. 3 is a sectional view at right angles to the cylinder axis of the cylindrical sleeve 12 and the ferromagnetic V-shaped bent plates 22, 23 and 24 and taken on the line III—III of FIG. 5. The bulge 28 extends in hole 29 and fixes the said plate in the axial and radial directions.

In FIG. 4 the lug 30 extends through slot 31, which represents another embodiment of the fixation.

FIG. 5 is a sectional view taken on the line V—V of FIG. 2. In this case the short projection 26 extends through the hole 27.

What is claimed is:

1. A color cathode-ray tube having, in an evacuated envelope, means to generate three electron beams, a display screen comprising a large number of regions luminescing in three different colors, a color selection electrode having a large number of apertures and means to converge the electron beams on the display screen, said electron beams being each associated with luminescent regions of one color by means of the color selection electrode, said convergence means comprising a cylindrical sleeve to which three pairs of ferromagnetic pole shoes extending radially inwardly are secured and in which shielding means are present to shield the magnetic fields of the said pole shoes, said shielding means including three identical V-shaped bent plates the apexes of which join each other along the axis of the said cylindrical sleeve and the first and second ends of which extend from said axis towards the wall of the said cylindrical sleeve in such manner that the space in said cylindrical sleeve is divided into three symmetrical compartments in which the said pairs of pole shoes are present, said V-shaped bent plates having respectively at their first end a lug which projects through an aperture in the cylindrical sleeve and is welded to the outer wall thereof, and have at their second ends a short projection which extends in a corresponding other aperture in the cylindrical sleeve for fixation in the tangential direction and is not welded, and further comprising means for fixation of the adjoining plates in the radial and the axial directions, said means including a projecting part at one arm of one plate and a recess in the engaging arm of the other plate.

2. A cathode-ray tube as claimed in claim 1, wherein said projection is a local bulge and the recess is a hole in which the said bulge extends.

3. A cathode-ray tube as claimed in claim 1, wherein said projection is a lug and the said recess is a slot through which the said lug extends.

* * * * *